US005788575A

United States Patent [19]

Fluster

[11] Patent Number: 5,788,575

[45] Date of Patent: Aug. 4, 1998

[54] PORTABLE TABLE TOP

[76] Inventor: Alfred Fluster, 1560 S. McPherrin Ave., Monterey Park, Calif. 91754

[21] Appl. No.: 807,244

[22] Filed: Feb. 28, 1997

[51] Int. Cl.[6] ..... A47B 97/04

[52] U.S. Cl. ..... 248/463; 108/43

[58] Field of Search ..... 248/460, 454, 248/455, 447, 463; 108/43, 49

[56] References Cited

U.S. PATENT DOCUMENTS

| | | | |
|---|---|---|---|
| 236,741 | 1/1881 | Weaver . | |
| 300,234 | 6/1884 | Eldred . | |
| 492,316 | 2/1893 | White | 108/43 |
| 1,263,122 | 4/1918 | Sandstrom . | |
| 1,457,458 | 6/1923 | Plamondon | 248/455 |
| 2,476,620 | 7/1949 | Nichols . | |
| 3,121,884 | 2/1964 | Emery | 248/455 X |
| 3,172,636 | 3/1965 | Collier . | |
| 3,821,936 | 7/1974 | Morse | 108/43 |
| 4,645,163 | 2/1987 | Zovar | 248/452 |
| 5,639,053 | 6/1997 | Dmitriev | 248/460 |

FOREIGN PATENT DOCUMENTS 2381491 10/1978 France .

*Primary Examiner*—Ramon O. Ramirez
*Attorney, Agent, or Firm*—Elliott N. Kramsky

[57] ABSTRACT

A portable auxiliary table top for adaptation to a conventional horizontal-topped desk or table. A work surface member is hinged to an elongated support member along a common edge region. A semicircular locking member is pivotally engaged to the support member for securing a substantially perpendicular relationship therebetween to achieve a tilted work surface. The locking member may be released so that the support and work surface members are substantially parallel for easy transport. A handle and contacting pads of adhesive composition are fixed to the support and work surface members to assist during transport of the device.

8 Claims, 2 Drawing Sheets

PORTABLE TABLE TOP

BACKGROUND

1. Field of the Invention

The present invention relates to auxiliary table tops. More particularly, this invention pertains to a portable table top that includes an angularly-inclined work surface of the type that is adapted to modify a conventional table or desk to one suitable for the comfortable pursuit of drafting, artistic design and other tasks requiring a slanted work surface.

2. Description of the Prior Art

Work tables for artists, draftsmen, engineers, calligraphers, architects and the like commonly require a slanted or inclined top surface. Such a work surface enables one to maintain a comfortable posture while performing detailed design work over oftentimes protracted periods of time.

Commonly, design work must be performed away from the studio or office. One is therefore unable to utilize a specialized table. Therefore, an apparatus which will convert the otherwise-horizontal top of a conventional desk into a suitable tilted work surface is extremely useful for those regularly engaged in design tasks. The need for ready portability of such an inclined auxiliary top is furthermore apparent.

Prior art attempts to achieve a portable apparatus for converting a conventional desk top into a drafting-type table have been characterized by relatively-complex mechanisms. Examples of such mechanisms have included triangular wire brackets, multiple-locking mechanisms and the like. Such complex arrangements are subject to numerous failure modes and, furthermore, are often expensive and difficult to manufacture and much heavier.

SUMMARY OF THE INVENTION

The present invention addresses the shortcomings of the prior art by providing a novel portable auxiliary table top of simplified design. The table top of the invention includes a planar work surface member and an elongated planar support member. At least one hinge is provided for engaging an edge of the work surface member to an edge of the support member whereby the planar members are foldable about a common edge region to a substantial parallel relationship. Means are provided for selectively locking such members into a substantially perpendicular relationship along such common edge region.

The foregoing features and advantages of the present invention will become further apparent from the description that follows. Such written description is accompanied by a set of drawing figures. Numerals of the drawing figures, corresponding to those of the written description, point to the features of the invention. Like numerals refer to like features throughout both the written description and the drawing figures.

DETAILED DESCRIPTION

Figure 1:
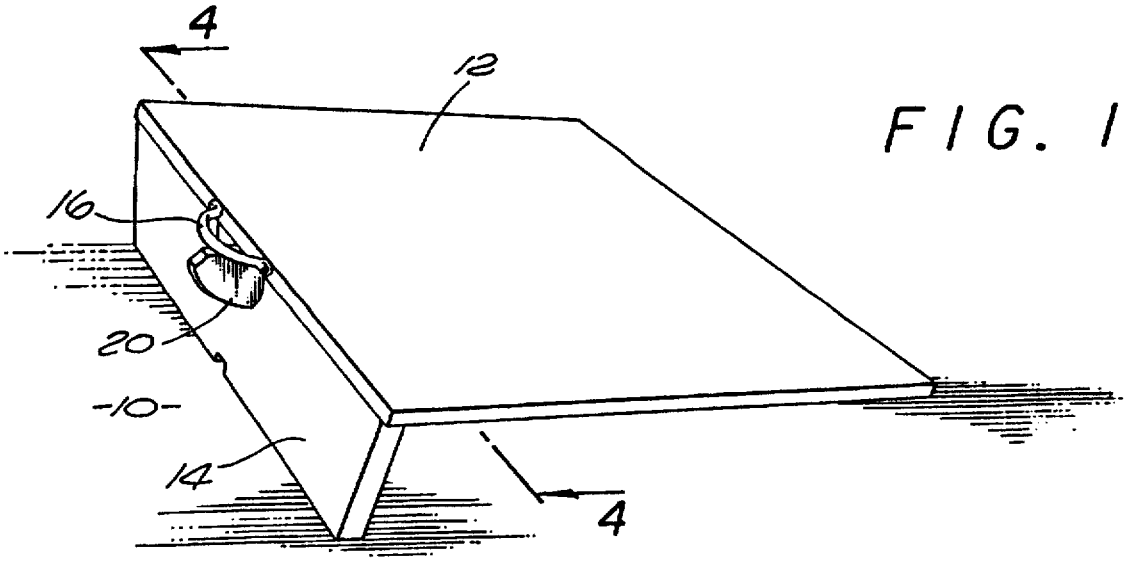
FIG. 1 is a perspective view of the invention in use as an auxiliary surface for converting a horizontal table or desk top to use for design or artistic work.
Figure 2:
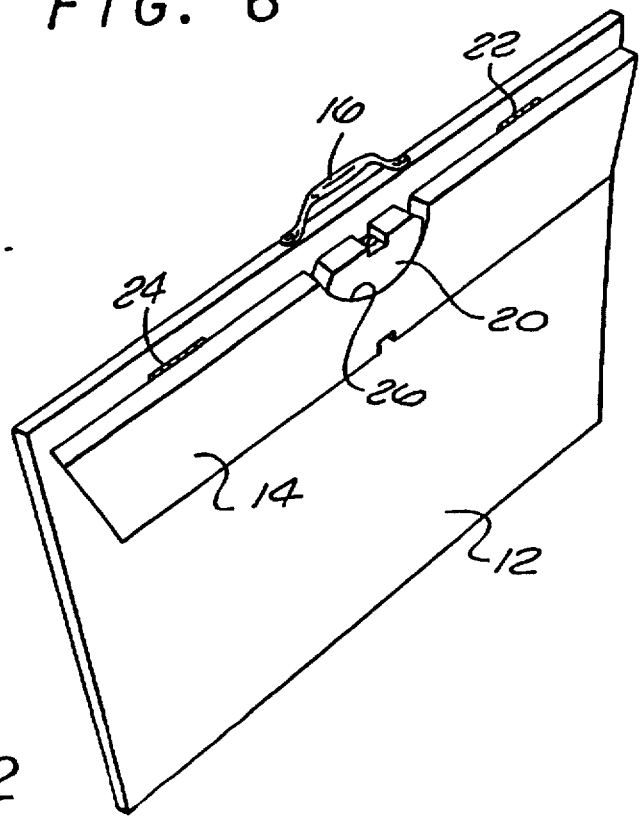
FIG. 2 is a perspective view of the invention compactly configured for ready transport to or from an out-of-office work site.

Turning now to the drawings, FIG. 1 is a perspective view of the invention in use as an auxiliary surface for converting a horizontal table or desk top 10 to use for design or artistic work. That is, the device of the invention is shown in its "locked" configuration whereby a tilted or angularly-inclined surface area is created atop the otherwise-horizontal work area of a conventional table or desk. FIG. 2 is a second perspective view of the invention showing the invention compactly configured for ready transport to or from an out-of-office work site. As shown, the two major elements, a planar work surface member 12 and an elongated support member 14 are substantially parallel while a handle 16 is provided for easy portability.

Figure 3:
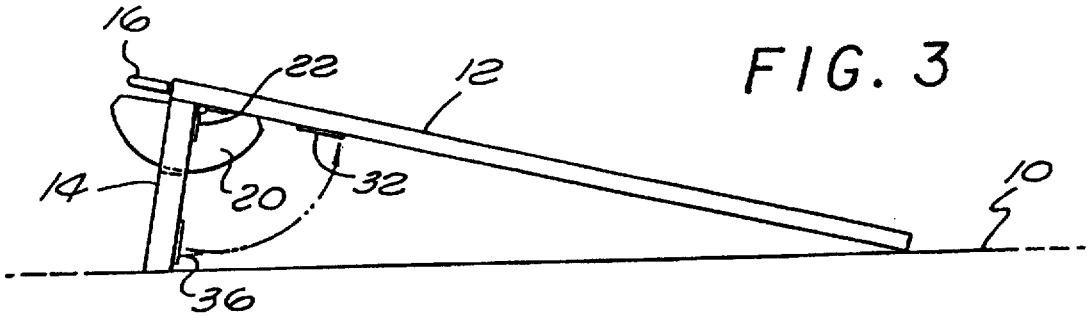
FIG. 3 is a side elevation view of the invention.

FIG. 3 is a side elevation view of the invention. The angular inclination attained is clearly shown. The auxiliary table top includes the planar work surface member 12 that is hingedly-engaged to the elongated planar support member 14. Each of the members 12 and 14 is preferably formed of wood, either solid or the 11/16 inch birch veneer board that is quite popular with artists, draftsmen and others. Often, such a board includes a hollow core, rendering it relatively lightweight. A semi-circular locking member 20 is provided for securing the member 12 in an approximately orthogonal relationship to the member 14, thereby tilting the member 12 with respect to the horizontal surface 10 to achieve the configuration of FIG. 1. When released, the member 20 permits the travel configuration of FIG. 2.

Figure 4:
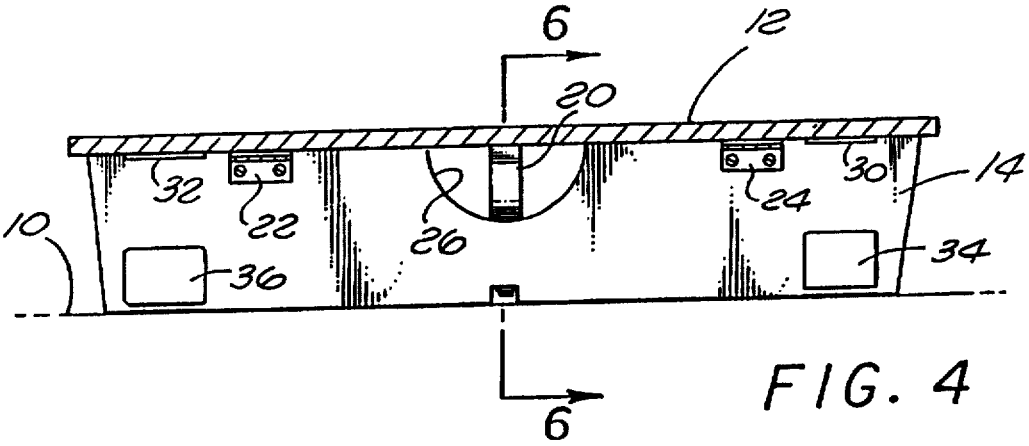
FIG. 4 is a rear elevation view of the invention in cross-section taken at section line 4—4 of FIG. 1.

FIG. 4 is a rear view of the invention in cross-section taken at the line 4—4 of FIG. 1. As can be seen, a pair of hinges 22, 24 each of which is fixed to both the back surface of the support member 14 and the bottom of the work surface member 12 provides a foldable relationship between the members 12 and 14.

Figure 6:
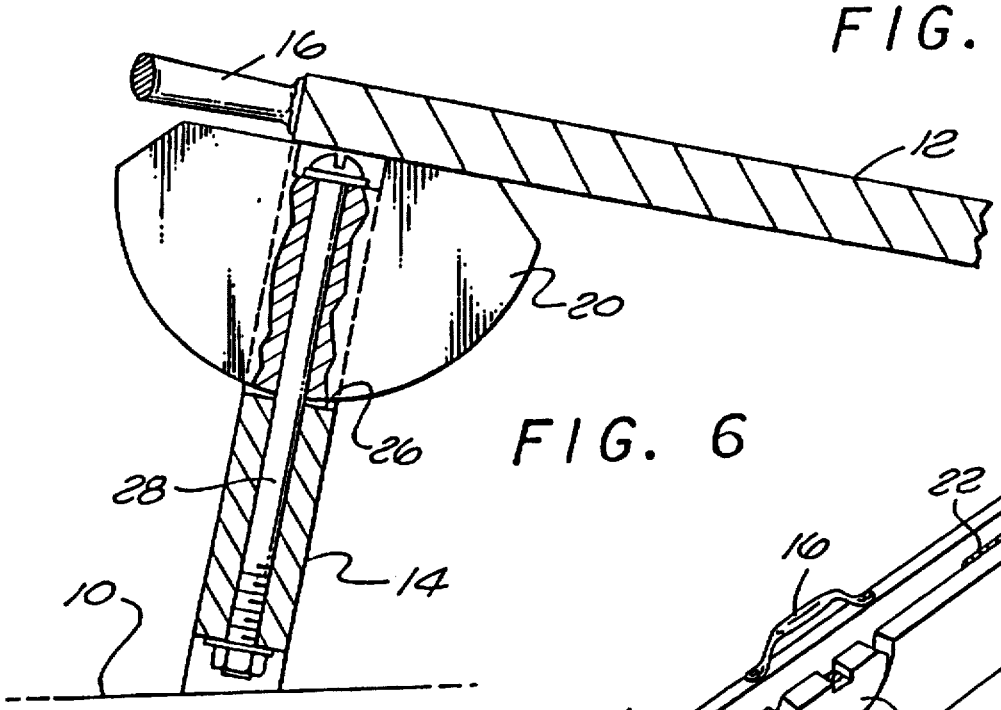
FIG. 6 is a cross-sectional side elevation view of the invention taken at line 6—6 of FIG. 4 for illustrating the pivoted locking means of the invention.

A semi-circular aperture 26 is formed or cut at the top edge of the support member 14 for accommodating the generally-semicircular locking member 20. As shown in FIG. 4 (as well as the prior figure), the locking member 20 is aligned approximately orthogonal to the major surface of the support member 14, maintaining an approximately-perpendicular relationship between the major surfaces of the working surface member 12 and the support member 14. As shown in FIG. 6, a cross-sectional side elevation view of the invention taken at line 6—6 of FIG. 4, the locking member 20 is pivotally engaged to the work surface member 12 for rotation within the portion of the support member 14 defined by the semicircular aperture 26 by means of a bolt 28 as shown.

Figure 5:
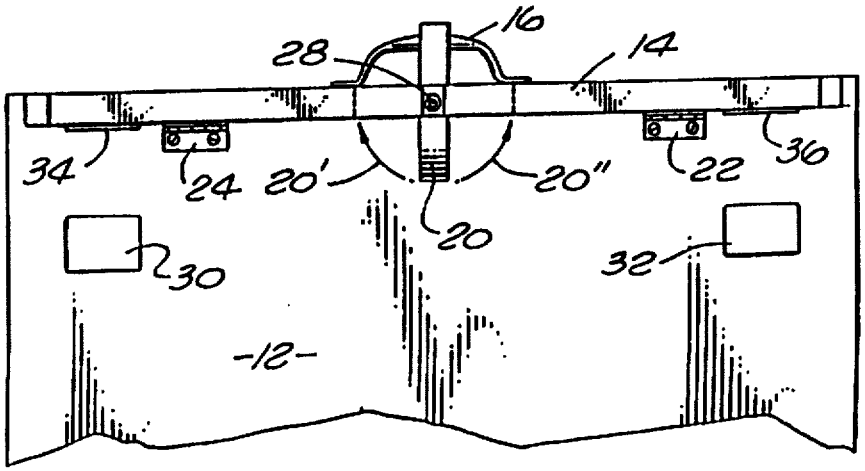
FIG. 5 is a bottom plan view of the front portion of the invention.

FIG. 5 is a partial bottom plan view of the front end of the invention. The locking member 20 is shown in that view in position to secure the work surface member 12 approximately perpendicular to the support member 14. Arrows 20' and 20" indicate the change in position of the locking member 20 when it is rotated about the bolt 28 from its orientation for securing the configuration (member 12 vis-a-vis member 14) of FIG. 1 to its orientation for permitting the configuration of FIG. 2.

Pads of adhesive material 30 and 32 are fixed to the bottom of the work surface 12 while pads of compatible material composition 34 and 36 are fixed to the rear face of the support member 14. The pads 30 and 34 and the pads 32 and 36 are located so as to form contacting pairs when the locking member 20 is released and the portable configuration of FIG. 2 assumed. The pads may be of any appropriate self-adhering composition such as that which is commercially available under the "VELCRO" trademark. By providing pads of such composition, the relationship demonstrated in FIG. 2 between the members 12 and 14 is secured and the member 14 is prevented from "flapping" without requiring grasping of any portion of the invention other than the handle 16. Thus, the compactness of the arrangement illustrated in FIG. 2 is maintained during transport.

Thus, it is seen that the present invention provides a novel and improved auxiliary table top for drafting and artistic uses. While this invention has been described with respect to its presently preferred embodiment, it is not limited thereto. Rather, the scope of this invention is only limited insofar as defined by the following set of claims and includes all equivalents thereof.

What is claimed is:

1. A portable auxiliary table top comprising, in combination:

a) a planar work surface member;

b) an elongated planar support member;

c) at least one hinge for engaging an edge of said work surface member to an edge of said support member whereby said planar members are foldable to a substantially parallel relationship about a common edge region;

d) means for selectively locking said members into a substantially perpendicular relationship along said common edge region, said means including (i) a substantially semicircular member, (ii) said support member having a semicircular aperture adjacent said common edge region for accommodating said last-named member and (iii) means for pivotally mounting said semicircular member to said support member.

2. A table top as defined in claim 1 further including:

a) a handle; and b) said handle is fixed to the periphery of said work surface member adjacent said common edge region.

3. A table top as defined in claim 2 wherein said handle is fixed to the middle of said periphery.

4. A table top as defined in claim 1 further including means for securing said substantially parallel relationship between said support member and said work surface member.

5. A table top as defined in claim 4 wherein said means for securing said parallel relationship further includes:

a) at least one pad fixed to the bottom, inwardly-facing surface of said word surface member;

b) at least one pad fixed to the back, inwardly-facing surface of said support member;

c) said at least one pad fixed to said support member and said at least one pad fixed to said work surface member being arranged to contact when said members are in parallel alignment; and d) said at least one pad fixed to said work surface member and said at least one pad fixed to said support member being of such compositions as to adhere when in contact.

6. A portable table as defined in claim 1 including two hinges.

7. A portable table as defined in claim 6 wherein said hinges are symmetrically fixed to the peripheries of said work surface and support members adjacent said common edge region.

8. A portable table as defined in claim 6 further characterized in that said work surface member, said support member and said substantially semicircular member is each substantially of wood composition.

* * * * *